United States Patent [19]

Svensen

[11] Patent Number: 4,892,495

[45] Date of Patent: Jan. 9, 1990

[54] SUBSURFACE BUOY MOORING AND TRANSFER SYSTEM FOR OFFSHORE OIL AND GAS PRODUCTION

[76] Inventor: Niels-Alf Svensen, Leanglia 16, N-1370 Asker, Norway

[21] Appl. No.: 188,551

[22] PCT Filed: Mar. 24, 1987

[86] PCT No.: PCT/NO87/00025

§ 371 Date: May 6, 1988

§ 102(e) Date: May 6, 1988

[87] PCT Pub. No.: WO87/05876

PCT Pub. Date: Oct. 8, 1987

[30] Foreign Application Priority Data

Mar. 24, 1986 [NO] Norway ..... 861171

[51] Int. Cl.[4] ..... B63B 22/02

[52] U.S. Cl. ..... 441/5; 114/230

[58] Field of Search ..... 441/2–5; 114/230; 166/352, 354, 355

[56] References Cited

U.S. PATENT DOCUMENTS 3,258,793 7/1966 Schultz ..... 441/5

4,490,121 12/1984 Coppens et al. ..... 441/5

4,604,961 8/1986 Ortloff et al. ..... 441/4

FOREIGN PATENT DOCUMENTS 2069955 9/1981 United Kingdom .

*Primary Examiner*—Sherman D. Basinger

*Attorney, Agent, or Firm*—Wenderoth, Lind & Ponack

[57] ABSTRACT

A subsurface buoy loading system for offshore oil gas production from production wells in the sea bottom. One or more flexible risers lead from the respective production wells to a submersible buoy adapted to be fitted to a complementary loading vessel in order to transfer petroleum products from the production wells via the loading buoy to the cargo space in the vessel. When not carrying out loading operations the loading buoy is descended down into an equilibrium position in the body of water. In the loading vessel the buoy is fitted into a rotatble turret seat located in a downwardly open tunnel in the ship hull. The rotatable turret seat is positioned at such a level that the top side of the buoy, when in the loading position, is situated above sea level. The riser or risers extend through a vertical shaft in the buoy and are attached to the top of the buoy. The rotatable turret seat supports pipes communicating between the risers and a receiving pipeline system in the vessel.

10 Claims, 3 Drawing Sheets

SUBSURFACE BUOY MOORING AND TRANSFER SYSTEM FOR OFFSHORE OIL AND GAS PRODUCTION

BACKGROUND OF THE INVENTION

This invention concerns in general offshore oil and gas production from production wells in the sea bottom, and more especially new arrangements for a so-called buoy loading system. Such systems can be used instead of floating or semi-submersible production platforms, and comprise a submerged or subsurface buoy which forms a connection point for a bundle of flexible risers from production wells on the sea bottom. The buoy is designed to stand in an equilibrium position in the water body and to be able to rise and be made fast or attached to a turret system in a complementary loading vesel to establish a transport conveyor system for the petroleum products from the production wells to the loading tanks onboard the vessel.

Several designs for such buoy loading systems are known. Usually the buoy is anchored to the bottom of the sea with a plurality of anchoring chains such that the buoy is positioned in a stable equilibrium position at the desired water depth and along a vertical axis. The buoy is dimensioned such that it has sufficient buoyancy to carry the weight and the loading from anchor chains as well as the weight of the risers while assuming a predetermined neutral position, which is called a stowage position, in the water. The buoy will be given sufficient buoyancy such that it can be raised into contact with the vessel positioned above the buoy with the help of winches and wire systems, or it can be brought up under its own buoyant force. A ship fitted with a loading system as described is normally provided with a downwardly opening tunnel or shaft, which in turn is provided with a rotatable turret or rotatable system for receiving the buoy and for attaching the buoy to this turret and for attachment of the risers to piping systems in the vessel. In known constructions the anchor chains and risers are hung or attached to the bottom of the buoy. Between the buoy and the tunnel or the rotatable system in the hull structure, sealing systems can also be provided such that the buoy can be attached to the hull of the vessel providing a watertight room inside. When the buoy is attached in its seat or turret the sea water from the buoy's top side in this tunnel may be pumped out such that a dry working space on the top of the buoy can be provided. Thereby it will be easier to attach couplings between the risers in the buoy and the piping systems on the ship for transmitting petroleum fluids to the vessel's cargo tanks.

It is necessary that the vessel can rotate freely with respect to the buoy such that the vessel can turn with wind and weather about the buoy, which cannot turn because of the risers and the anchoring system. A buoy loading system can, however, to a great degree and without problems, be subjected to vertical movements and present certain advantages compared to floating and semi-submersible platforms because a loading vessel with a rotatable buoy leading system can turn according to the wind and weather to provide a robust sea-going unit. This means that production and loading can be maintained under hard weather, eventually also in areas with ice problems.

When not in use the loading buoy is stowed at a depth of water which is below all seagoing traffic, normally by about 30 meters under the surface of the sea. When it is to be used the buoy is brought up and into the rotatable turret such that the vessel can freely turn about the buoy according to the wind and weather conditions. In position in the turret, the buoy's anchoring system will also provide sufficient forces to maintain the position of the vessel under any weather conditions.

A system which makes it possible for the vessel to turn around the buoy is called a turret. The buoy is mechanically linked to the turret which can turn or roll or glide on systems on the inside of the vessel's tunnel construction and is a part of or is connected to the ship's structure.

Turrets have been used for a long time for anchoring of vessels such as drill vessels. The classically designed turret anchor system is, however, costly, complicated and difficult to maintain and to operate.

In addition, methods to connect the risers to a turreted anchored vessel are complicated, especially with a plurality of risers or a riser bundle. There exists no good solution which makes it possible to safely and rapidly disengage or connect the riser systems. According to known and published technology, subsurface buoys are connected to a vessel in a moonpool. A moonpool is a room or space over a dam formed in the open well of the vessel or recess which requires that this dam be watertight and the water above the buoy must be removed to provide a safe and dry working space. Furthermore, known designs and technology have to date not shown any means which makes it possible to adjust anchor cables or chains when the buoy is installed and attached to the vessel, and this technology also does not show any direct ways to gain access to risers or for installing these under normal operating conditions.

BRIEF SUMMARY OF THE INVENTION

The invention described herein soles these and other problems. A buoy is attached to a vessel in a position above the water line inside a tunnel or the moonpool in the vessel. Furthermore, anchor chains are carried through the buoy to the top of the buoy in mooring or chain pipes which make it possible for the buoy's anchor chains to be adjusted and eventually replaced, if necessary. In the preferred embodiment of this invention, risers are in the same manner extended directly to the top of the buoy through a preferably centrally extending riser trunk, in which manner one can gain direct access to the riser's upper end such that the riser's upper end can be attached directly to a communicating piping system in the vessel.

An important feature of the preferred embodiment of the invention rests in that the rotatable turret seat serves as support for pipe means operating as a receiving station and communicaton point between the top end of the risers on the buoy and a pipeline system on the vessel. Thereby one can overcome the inherent problem with the rotative movements of the buoy relative to the receiving pipeline system in the vessel.

Raising of the buoy is carried out by remote control of an air systems in the buoy. More specifically, compressed air is released in the buoy to blow out the buoy's water ballast, and in this manner the buoy is given added buoyancy. The buoy can therefore be raised into a desired position inside the moonpool, provided that the vessel beforehand has been positioned correctly above the submerged buoy. When the buoy is to be lowered, additional ballast is brought onboard the buoy, such that the total weight exceeds the buoyancy of the buoy. This total weight consists of the buoy weight, the weight of the risers and the weight of that portion of the anchor chains which have been raised from the sea bottom. When the buoy is released from the turret it will then sink to a water depth where a sufficient amount of the anchor chains have been lowered onto the sea bottom such that the buoyant forces equal the net total weight of the buoy. To simply reach the point of equilibrium, clump weights can be attached to the anchor chains or be attached to the buoy directly with chains or wire ropes, and the buoy will then cease sinking when these clump weights are lowered onto the sea bottom.

The invention involves other advantages and features which will appear from the following description in connection with the drawings.

BRIEF DESCRIPTION OF THE DRAWINGS

An embodiment of the invention is described in the following with reference to the attached drawings, wherein.

DETAILED DESCRIPTION OF THE INVENTION

Figure 1A:
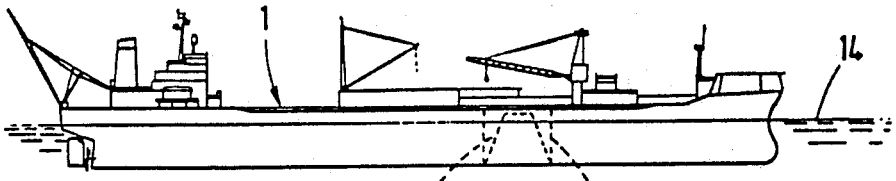
FIGS. 1*a* and 1*b*, respectively, are elevation and plan views of a vessel designed in accordance with the invention.
Figure 1B:
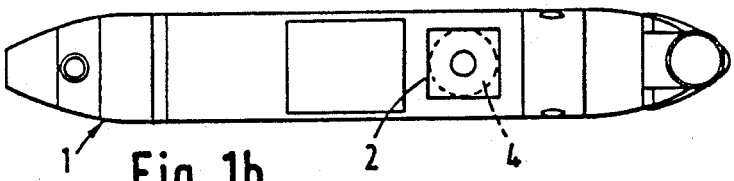

FIGS. 1*a* and 1*b* show a lateral and a plan view, respectively, of a buoy loading vessel having a tunnel or shaft designed in accordance with the present invention. The number 1 refers to the vessel. The number 2 refers to a vertical tunnel through the ship, here shown as a rectangle. In this tunnel, called a moonpool, is mounted a conical bearing construction 4 fitted for receiving a corresponding dimensioned conically-formed loading buoy. The largest diameter of the construction 4 is at the bottom of the vessel.

Figure 2:
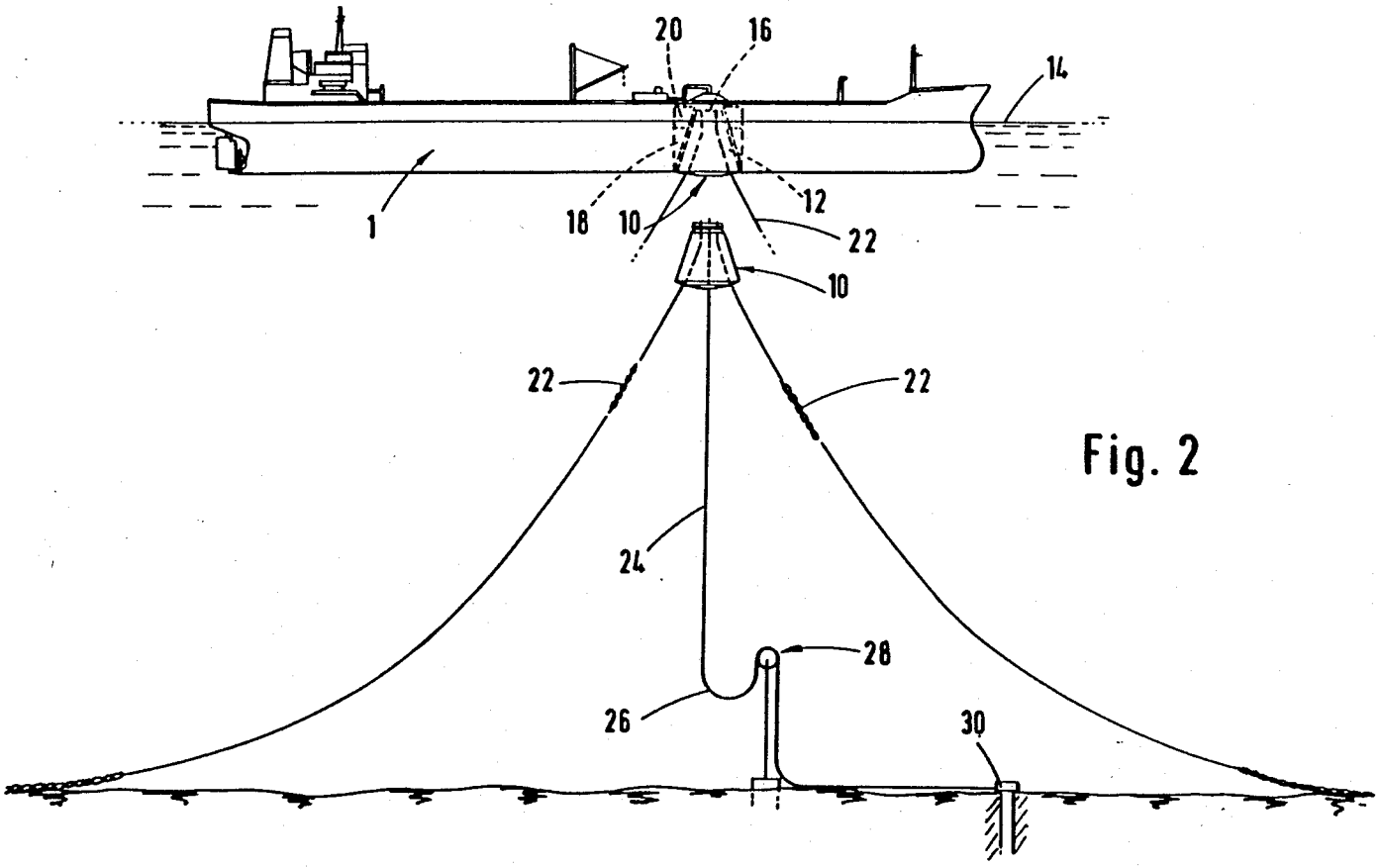
FIG. 2 is a schematic view illustrating a buoy according to the invention in both stowed position in the water and in anchored position when the buoy is locked in a moonpool in a turret in a vessel.

FIG. 2 illustrates in more detail the buoy and the tunnel. The buoy is designated with the number 10 and is shown here in the stowed position underneath the vessel. Dotted lines 12 show the buoy in its attached position in the tunnel in the vessel. The water line of the ship in its loaded condition is described with the number 14. This Figure shows a buoy deck 16 in position above; the water line in the tunnel or moonpool while under deepest draft. In the tunnel there is a conical carrying construction 18 fitting the conical structure of the buoy 10. In the moonpool's upper part is mounted the turret, which is a rotatable seating construction 20 for the buoy. The central new feature of this invention is that the construction of the buoy is such that the buoy's upper deck will be in a position above the ship's water line. The buoy is anchored to the sea bottom with a number of anchor chains 22, of which two are shown. The buoy is shown further with a number of flexble risers 24. Only one riser is shown in the interest of clarity in this drawing. The riser normally hangs vertically in the sea and runs with a bottom bow 26 over a supporting buoy or saddle 28 which is anchored to the bottom. From the saddle 28 the riser goes down to the ocean bottom and along the ocean bottom to a production well 30. This configuration prevents rubbing of the riser on the ocean floor when the buoy and the vessel move. This also allows the buoy to be more easily positioned substantially stably along a vertical axis. The buoy is dimensioned and designed with buoyancy sufficient to support the risers and part of the anchor lines or chains, such that the buoy attains an equilibrium position at a certain depth, since the buoyancy of the buoy will balance the weight of the risers and that part of the anchor chains which are being elevated up from the sea bottom by means of the buoy buoyancy force.

When the buoy is going to be raised and attached to the vessel, the vessel is positioned with the central axis of the tunnel or moonpool right above the buoy's center axis as illustrated in FIG. 2. Raising of the buoy up into this tunnel can be accomplished either by increasing the buoyancy of the buoy, or by winching cables which are lowered through the tunnel and attached to the buoy. The preferred manner in which to carry this out according to the invention is to raise the buoy by increasing its buoyancy by blowing ballast out of the ballast tanks in the buoy such that the ballast water is driven out and its volume replaced by air, with the result that the buoy rises.

Figure 3:
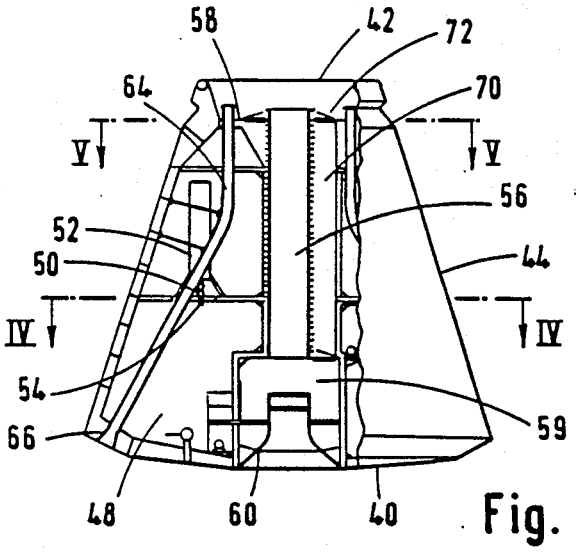
FIG. 3 is a partial vertical section of the buoy according to the invention.

A buoy formed according the invention is illustrated in FIG. 3. The buoy is generally formed with a bottom 40 and a top 42 and a conical side plate or side surface 44. The buoy houses ballast spaces 48, ballast valves 50 plus one or more compressed air tanks 52 which are connected to the ballast spaces via pipes 54. The buoy is provided with a central through-going tunnel or trunk 56 which at the top opens onto a buoy deck 58, and in the bottom opens into a room or chamber 59. Through the room 59, the riser is carried down and out of the buoy through a bellmouth 60. Room 59 serves as an inspection chamber and a place where divers can rest. The buoy is furthermore provided with chains pipes 64 for carrying the chains and each of which has a conical bellmouth 66 on the bottom and open onto the buoy deck on top.

Figure 4:
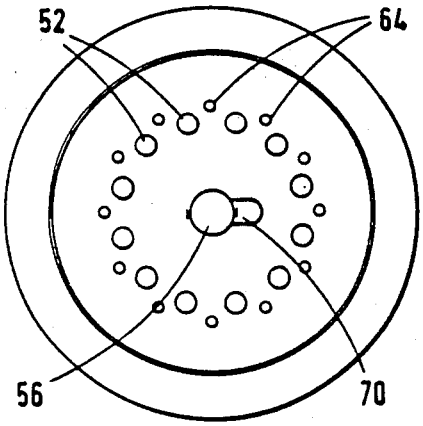
FIG. 4 is a horizontal section along the plane IV—IV from FIG. 3.

FIG. 4 illustrates the placement and the design of the riser trunk 56 and the chain pipes 64 which carry the anchor chains 22. In this sketch the number 70 shows a man hole with a lid 72 as shown also on FIG. 3.

Figure 5:
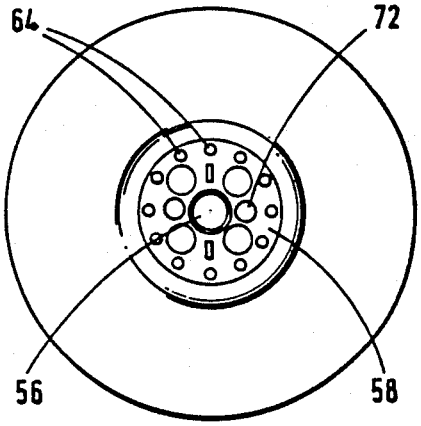
FIG. 5 is a horizontal section along the plane V—V shown in FIG. 3.

FIG. 5 shows chain pipe 64, the riser trunk 56 and man hole lid 72.

Figure 6:
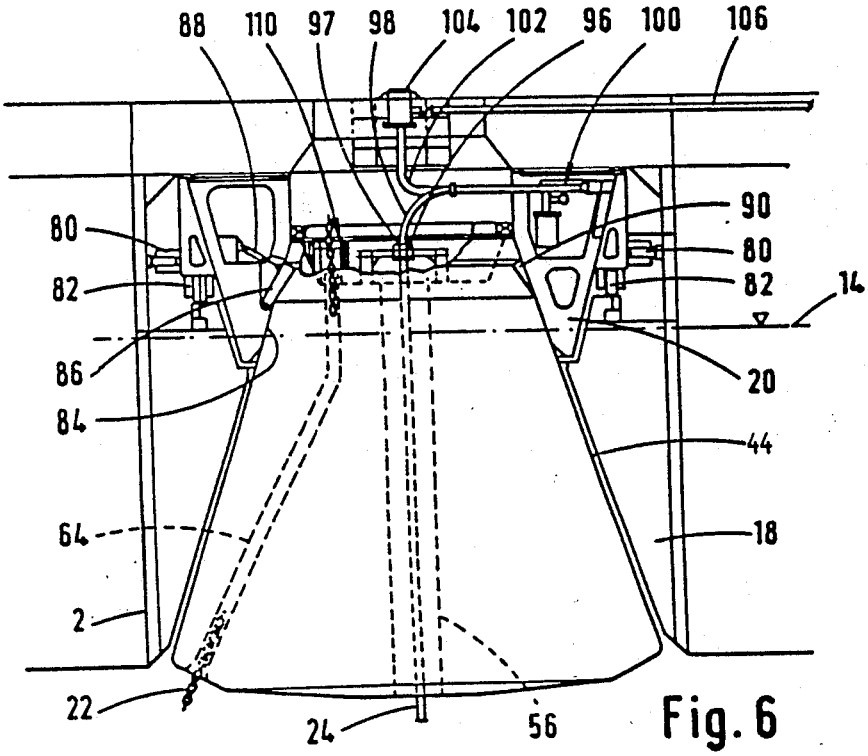
FIG. 6 is a vertical section at an enlarged scale of the buoy coupled to the turret in the vessel.

FIG. 6 illustrates the buoy in its anchored position in the vessel. The inside conical rotatable turret 20 is supported by axial and support bearings 80 and 82, respectively. Bearing 82 may be a thrust bearing. The turret's inside surface 84 is provided with a number of swinging latches 86 connected with pneumatic or hydraulic cylinders combined with spring and working cylinders 88. The construction is such that when the buoy rises in the tunnel the buoy's side plate will press the latches out whereafter they fall into a latch notch 90 in the buoy surface 44. In this way a safe and simple locking of the buoy is obtained at the proper height. As mentioned earlier, the buoy is preferably raised by blowing ballast and increasing the bouyancy of the buoy. The ballast water is blown with water from the compressed air tanks 52 which communicate with the buoy's ballast chambers 48 through the piping system 54 which can be remotely controlled from the vessel. Riser 24 is shown freely hanging through the riser trunk 56 in the buoy and are anchored or mounted in foundations or anchoring posts 96 on the buoy deck 58. At the upper end 97 of each single riser 24 is a closing valve, not shown, for closing the riser when the buoy is going to be stowed in the sea again. The position shown in FIG. 6 shows the riser connected to the vessel's receiving system via piping or pipeline connector 98. The piping is carried horizontally out to a product receiving descending cleaning system 100 mounted in the turret 20, whereafter a pipe 102 leads back to the center line of the buoy and vertically up through a swivel 104. From this swivel transport piping 106 will run to the ship's loading tanks or to a processing system. The solution shown will make it possible for these devices to be anchored or connected to the buoy very simply and for the buoy to be attached to the vessel regardless of the buoy's position with respect to the vessel. The buoy's anchor chains 22 are shown carried through the chain pipes 64 to chain stoppers 110. In position over these chain stoppers are mounted winches, not shown, for regulating the anchor chains' length and tension. When tightening one or several of the anchor lines or chains, the same may, by means of said winches, be hoisted up through the chain pipes in the buoy. If one or more of the anchor chains is to be slackened, i.e. be extended, the top of the respective anchor chain is provided with an additional section of chain.

It will be understood from the shown solution that a dry working area is provided on top of the buoy. In this manner all connections to both the anchor chains 22 and risers 24 stay in a dry working area when the buoy is attached to the vessel. Furthermore, operative equipment such as pipelines, valves and cleaners, are positioned above the water-line of the ship even under high draft. The bottom side of the buoy is substantially flush with the bottom side of the ship when the buoy is anchored in the ship.

Between the lower part of the buoy and the adjacent wall, sliding elements may be provided for absorbing lateral forces from the anchor chains.

When the ship is loaded and the loading buoy is to be released and lowered under the ship, the air tanks 52 are loaded with air, the buoy's ballast tanks 48 are filled with water, and the latches 86 are pulled out of the latch notch 90 in the side surface of the buoy. All piping connections have already been removed from the top of the risers, and the valve at the top of each of the risers has been closed off. The buoy will then sink and achieve a position as previously shown in FIG. 2 at about 30 meters below the surface of the water.

If the buoy is to be released from the anchor chains and/or the risers, this can easily be carried out by releasing the anchor chains and/or the risers from the locking means on the top or deck of the buoy while the same is positioned in the turret, and is subject to dry working conditions.

It is understood that many modifications of the shown construction are possible within the framework of the invention. The buoy does not necessarily have a conical shape, but can have a cylindrical upper part and a conical lower part or vice versa. The essential function is that the buoy has such a construction that it can easily be brought into the tunnel and the turret in the vessel. In the same manner, the anchor chains and the risers do not necessarily have to be carried through the buoy, although this is the preferred design.

The buoy when attached to the vessel provides an anchor for the vessel such that the vessel can turn with wind and weather.

The buoy can, however, also be used with a ship which is dynamically positioned, such as a shuttle-tanker. The essential function for the buoy is to provide buoyancy to carry the risers up and into the vessel such that they are accessible and can be attached to the systems for loading the tanker.

With respect to dimensions and weights, a "normal" loading buoy according to this invention can reach a height of 20 meters and a diameter of 15 to 20 meters and have a buoyancy between 2500 and 3500 tons.

I claim:

1. A subsurface vessel mooring and loading system for offshore petroleum production, comprising:

submersible buoy to be anchored to a sea bed by a plurality of mooring lines to extend from the sea bed to said buoy;

at least one riser pipe to extend from at least one production well in the sea bed and having a top end connected to said buoy;

a loading vessel having a hull, and open tunnel shaft opening into said hull, and receiving loading facilities;

a rotatable turret seat mounted in said tunnel shaft to extend above the high draft water line in said tunnel shaft, said turret seat having a generally annular ring shape, said buoy being adapted to be firmly seated in said turret seat such that a top side of said buoy is above the high draft water line in said tunnel shaft, and product receiving means in said turret seat;

first product transfer means extending laterally from said top end of said at least one riser pipe to said product receiving means of said turret seat; and second product transfer means extending between said turret seat and said receiving loading facilities of said vessel.

2. A system as claimed in claim 1, wherein said first product transfer means includes a separate pipeline connector extending between said top end of each of said at least one riser and said product receiving means of said turret seat.

3. A system as claimed in claim 1, wherein said second product transfer means includes a pipe swivel on said vessel and located substantially along the longitudinal axis of said tunnel shaft.

4. A system as claimed in claim 3, wherein said second product transfer means includes piping means extending between said product receiving means of said turret seat and said pipe swivel.

5. A system as claimed in claim 3, wherein said second product transfer means includes transport piping means extending between said pipe swivel and said loading receiving facilities.

6. A system as claimed in claim 1, wherein said turret seat is positioned within said tunnel shaft at a level such that when said buoy is seated in said turret seat a bottom surface of said buoy extends substantially flush with a bottom side of said loading vessel hull.

7. A system as claimed in claim 1, wherein said tunnel shaft includes an annular ledge, and said turret seat is supported on said annular ledge by thrust bearings.

8. A system as claimed in claim 1, wherein said buoy includes a riser passage which opens onto said top side of said buoy, said at least one riser extending freely through said riser passage and having said top end of said riser connected to said top side of said buoy by anchoring posts.

9. A system as claimed in claim 1, wherein said buoy includes a plurality of chain pipes extending therethrough and which opens onto said top side of said buoy, such that the mooring lines can be extended through respective ones of said chain pipes and be anchored to said top side of said buoy by locks.

10. A system as claimed in claim 1, further comprising lateral support surfaces within said tunnel shaft below said turret seat, said support surfaces supporting a lower part of said buoy in order to absorb or resist laterally directed loads.

* * * * *